US008506008B2

(12) United States Patent
Pan

(10) Patent No.: US 8,506,008 B2
(45) Date of Patent: Aug. 13, 2013

(54) FOLDABLE SEAT STRUCTURE

(75) Inventor: Toung-Chun Pan, Tainan (TW)

(73) Assignee: Oasyschair Co., Ltd., Tainan (TW)

( * ) Notice: Subject to any disclaimer, the term of this patent is extended or adjusted under 35 U.S.C. 154(b) by 334 days.

(21) Appl. No.: 13/075,268

(22) Filed: Mar. 30, 2011

(65) Prior Publication Data

US 2012/0248830 A1 Oct. 4, 2012

(51) Int. Cl.
*A47C 4/00* (2006.01)

(52) U.S. Cl.
USPC ..... 297/55; 297/239; 297/160

(58) Field of Classification Search
USPC ..... 297/55, 354.11, 335, 331, 160, 239, 297/56
See application file for complete search history.

(56) References Cited

U.S. PATENT DOCUMENTS 3,982,785 A * 9/1976 Ambasz ..... 297/160
4,722,567 A * 2/1988 Hashihara ..... 297/188.21
6,386,627 B1 * 5/2002 Tsai ..... 297/16.1
6,481,789 B1 * 11/2002 Ambasz ..... 297/55
6,755,468 B1 * 6/2004 Pan ..... 297/335
7,052,081 B2 * 5/2006 Leng ..... 297/58
7,147,286 B2 * 12/2006 Cesaroni et al. ..... 297/301.1
7,410,211 B1 * 8/2008 Lin et al. ..... 297/23
8,322,787 B2 * 12/2012 Smith ..... 297/239

* cited by examiner

*Primary Examiner* — David Dunn
*Assistant Examiner* — Erika Garrett
(74) *Attorney, Agent, or Firm* — Alan Kamrath; Kamrath IP Lawfirm, P.A.

(57) ABSTRACT

A foldable seat structure includes a front foot part and a horizontal pole of a height across the front foot part engaged with a rear foot part. A first forward extending part and a second forward extending part are mounted on a horizontal pole of the rear foot part, to be jointed with a corresponding holding part of the front foot part. A screw is used to restrict the joint position. The front foot part is further jointed to a back frame with a back pad and a chair cushion on a front of the rear foot part. The screw of the holding part and the first and second forward extending parts can be unlocked to facilitate the rear foot part to be cross-folding with the front foot part to greatly reduce size for the package to be sold.

6 Claims, 15 Drawing Sheets

FOLDABLE SEAT STRUCTURE

BACKGROUND OF THE INVENTION

1. Field of the Invention

The present invention relates in general to a foldable seat structure and, more particularly, to a foldable seat structure that is applied to a seat body to be conveniently folded to a compact size to facilitate a seat package to be sold, and also to a plurality of peripheral equipment handy to be replaced and assembled to fit various consumer's needs.

2. Description of the Related Art

A conventional seat body usually includes a foot part, a seat cushion, a back supporting part, a left armrest part and a right armrest part. The aforesaid seat body can be further equipped with a movable table top or a movable handrail to fit customer's needs.

However, even though the aforesaid seat body can be extended when in use or folded when not in use, a size of the folded seat body is still huge and is very inconvenient when the seat body is packed for sale. Moreover, since the seat body occupies a large space, the seat body can not be effectively stacked when the seat body is transported for sale. Hence a transportation cost of the conventional seat body is very expensive.

SUMMARY OF THE INVENTION

A foldable seat structure of the present invention is provided that can be applied to a seat body to be conveniently folded to a compact size to facilitate a seat package for sale, and also is provided with a plurality of peripheral equipment handy to be replaced and assembled to fit various consumer's needs. With the foldable seat structure of the present invention, a disadvantage of the conventional seat body that occupies a large space can be effectively improved by stacking the foldable seat structure when the seat body is transported for sale. Hence, the foldable seat structure of the present invention enables the seat body to be folded to a compact size, to greatly reduce a seat package size; and, also, a plurality of peripheral equipment can be easily replaced and assembled to meet various consumer's need.

A main objective of this invention is to provide a foldable seat structure body comprising a front foot part, a rear foot part, a back frame, a back pad and a chair cushion.

The front foot part comprises a first upward extending part and a second upward extending part mounted on a first horizontal pole of a specific height across the front foot part separately with an optimal spacing. Each of the first and second upward extending parts comprises a downward opening. A first protruding shaft and a second protruding shaft are formed on the front foot part of the same height near both ends of the first horizontal pole. Each of the first protruding shaft and the second protruding shaft comprises a through hole. A first holding part and a second holding part having an opening are extended backward located between the first and second upward extending parts and the neighboring protruding shafts.

The rear foot part comprises a first forward extending part and a second forward extending part mounted on two ends of a second horizontal pole of the rear foot part, to go through the downward opening of the first and second extending parts of the front foot part. The first and second forward extending parts are coupled to the corresponding first and second holding part. A first screw is used to restrict a first joint position. A flexible node is formed at two ends of the second horizontal pole on the rear foot part, to enable a support pole to be able to go through the second horizontal pole of the rear foot part located between the first and second extending parts above the front foot part. The support pole firmly goes through the first and second protruding shafts. A latch is used to restrict a second joint position.

First and second upper pole parts of the front foot part are coupled to the back frame to be screwed. The back pad is coupled to a front side of the back frame. A first connection unit and a second connection unit are configured on two ends of the second horizontal pole on the rear foot part separately with an optimal space. One end of the first and second connection units is coupled to a rear part of the chair cushion by screwing. The other end of the first and second connection units is mounted to a dragging part. A front end of the dragging part is stably fixed to a front part of the chair cushion.

When the foldable seat structure body is packed to be sold, the first screw of the first and second holding parts of the front foot part and the corresponding first and second forward extending parts of the rear foot part is unlocked. The rear foot part coupled to the chair cushion and the front foot part coupled to the back pad cross-fold the front foot part and the rear foot part, so that a folded size of the foldable seat structure body is greatly reduced to facilitate pile-up for transportation.

A second objective of the present invention is to provide the foldable seat structure body having a first handrail rod configured to at least one of the first and second protruding shafts of the front foot part pivoted to the rear foot part. The first handrail rod is coupled to a tabletop. A convex cover is formed at a peripheral of the one of the first and second protruding shafts of the front foot part that is configured to the first handrail rod.

A third objective of the present invention is to provide the foldable seat structure body having a second handrail rod configured to at least one of the first and second protruding shafts of the front foot part pivoted to the rear foot part. The second handrail rod is coupled to a handrail board. A convex cover is formed at a peripheral of the one of the first and second protruding shafts of the front foot part that is configured to the second handrail rod.

A fourth objective of the present invention is to provide the foldable seat structure body having a bottom of the front foot part and the rear foot part further configured with a wheel or a pillar by demand.

A fifth objective of the present invention is to provide the foldable seat structure body so that the back pad of the back frame coupled to the upper part of the front foot part can be replaced by a mesh back pad to be cool and comfortable for a user.

DETAILED DESCRIPTION OF THE INVENTION

Figure 1:
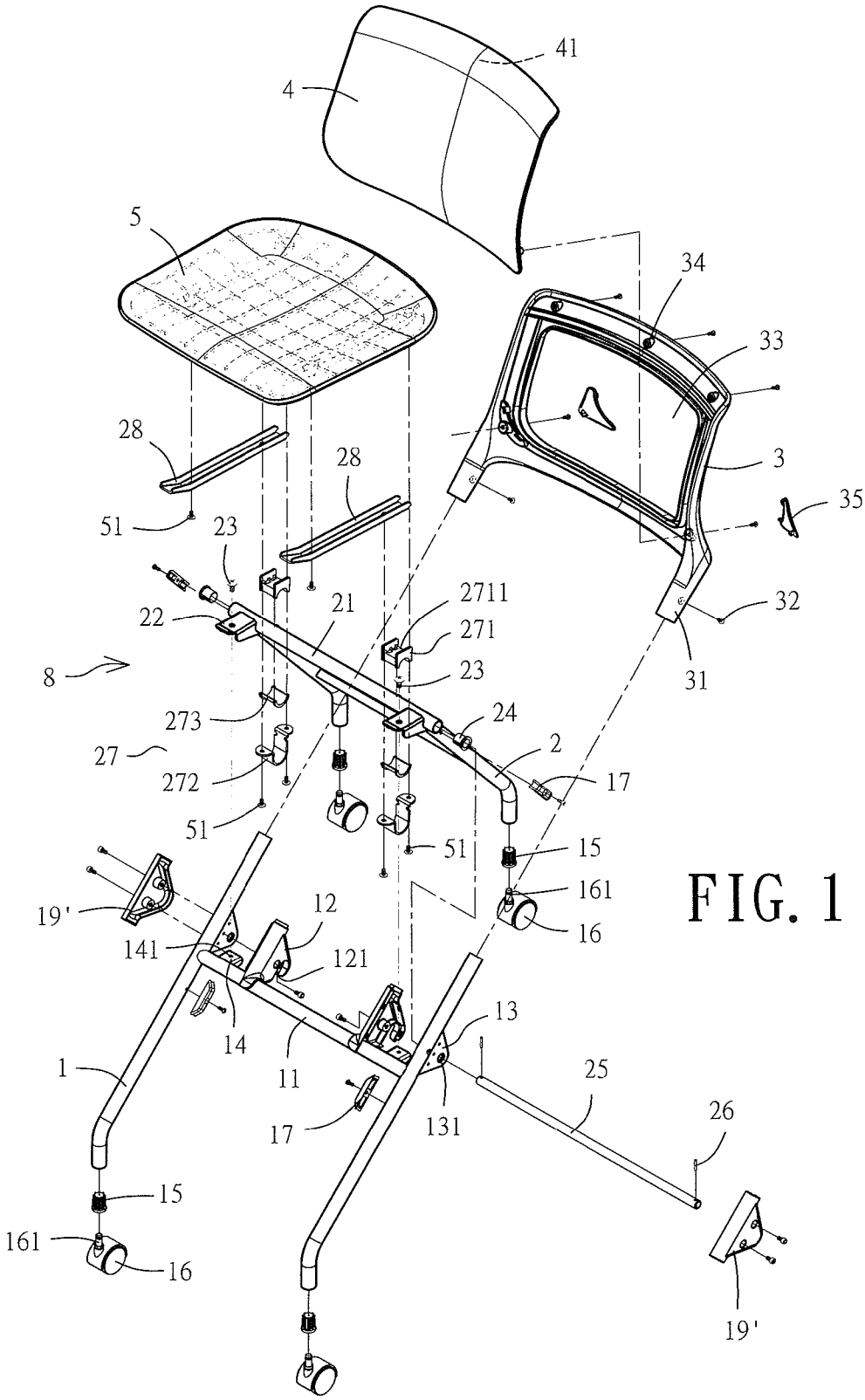
FIG. 1 shows a preferred embodiment of a component decomposition diagram of a foldable seat structure of the present invention.
Figure 2:
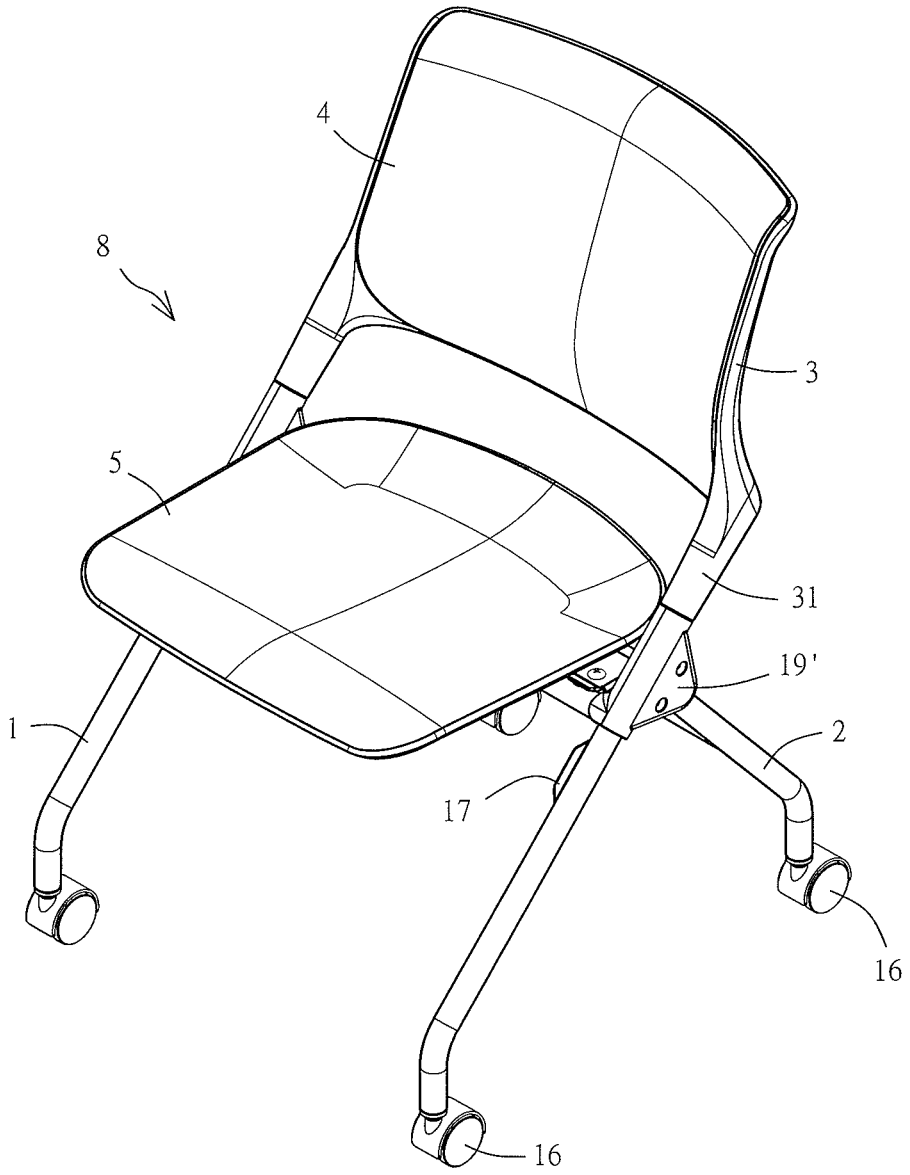
FIG. 2 shows a preferred embodiment of an external appearance diagram of a foldable seat structure of the present invention.

With reference to FIG. 1 and FIG. 2, a foldable seat structure body 8 of the present invention includes a front foot part 1, a rear foot part 2, a back frame 3, a back pad 4 and a chair cushion 5. A first upward extending part and a second upward extending part 12 are mounted on a first horizontal pole 11 of a specific height across the front foot part 1 separately with an optimal spacing. Each of the first and the second upward extending parts 12 forms a downward opening 121. A first protruding shaft and a second protruding shaft 13 are formed on the front foot part 1 of the same height near both ends of the first horizontal pole 11. A through hole 131 is formed on the first protruding shaft and the second protruding shaft 13 separately. A first holding part and a second holding part 14 having an opening 141 are extended backward located between the first and the second extending parts 12 and the neighboring second protruding shafts 13. Moreover, a flexible connecting column 15 is mounted on a bottom of the front foot part 1, to be tightly coupled to a branch part 161 of a wheel 16.

Figure 4:
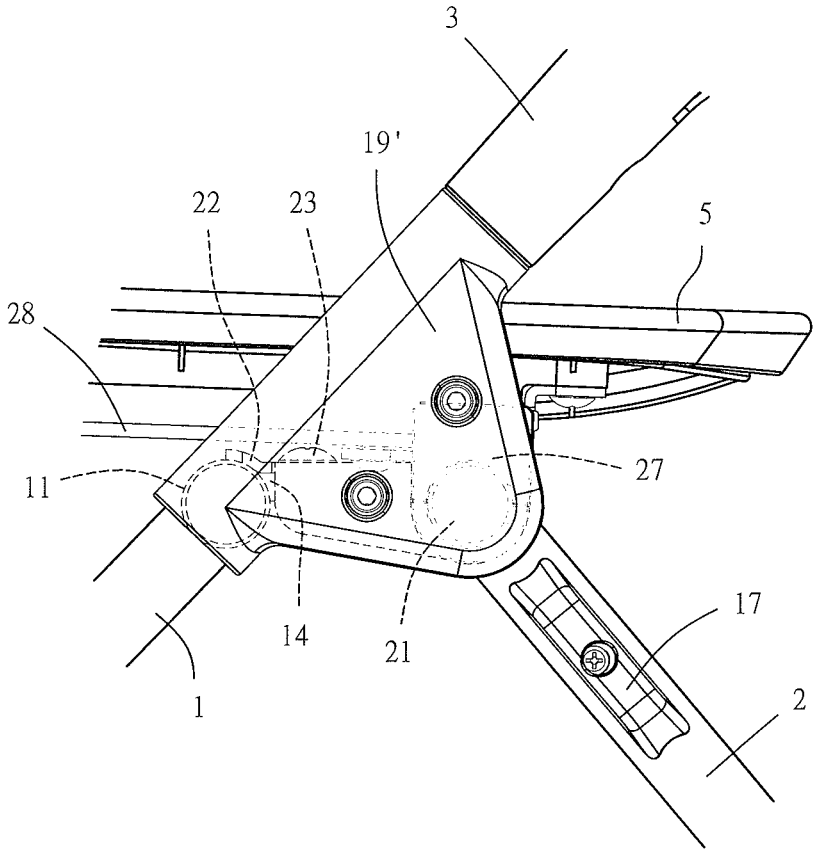
FIG. 4 shows a detail diagram of a part 40 of the FIG. 3 of a foldable seat structure of the present invention.

A first forward extending part and a second forward extending part 22 are mounted on two ends of a second horizontal pole 21 of the rear foot part 2, to go through the downward opening 121 of the first and second extending parts 12 of the front foot part 1. In this way, the first and second forward extending parts 22 are coupled to the corresponding first and second holding part 14 as shown in FIG. 1 and FIG. 4. A first screw 23 is used to restrict a first joint position. A flexible node 24 is formed at two ends of the second horizontal pole 21 on the rear foot part 2, to enable a support pole 25 to be able to go through the second horizontal pole 21 above the rear foot part 2 that is located between the first and second extending parts 12 of the front foot part 1. In this way, the support pole 25 firmly goes through the first and second protruding shafts 13. A latch 26 is used to restrict a second joint position. Moreover, a flexible connecting column 15 is mounted on a bottom of the rear foot part 2, to be tightly coupled to a branch part 161 of a wheel 16.

A first connection unit and a second connection unit 27 are configured on two ends of the second horizontal pole 21 on the rear foot part 2 separately with an optimal space. Each of the connection units 27 includes an upper clip 271, a lower clip 272 and a lower cover component 273. A notch 2711 is formed on a top of the upper clip 271 to be mounted to one end of a dragging part 28 as shown in the FIG. 4. In this way, the lower cover component 273 is coupled with the corresponding upper clip 271, to cover a specific section of the second horizontal pole 21 on the rear foot part 2. On the other hand, one end of the lower clip 272 is configured at a high position to be coupled to the chair cushion 5 and is locked by a second screw 51. In this example of a preferred embodiment of the present invention, the one end of the lower clip 272 is in a rear side. The other end of the lower clip 272 is configured at a low position to be connected against the dragging part 28 that is mounted on the notch 2711 of the upper clip 271 and is locked by the second screw 51. In this example of a preferred embodiment of the present invention, the other end of the lower clip 272 is in a front side. Furthermore, the two front ends of the dragging part 28 are configured to a front part of the chair cushion 5 and are locked by the second screw 51.

A first downward tube part and a second downward tube part 31 are formed on two sides of the back frame 3, to enable two upper pole parts of the front foot part 1 to be tightly mounted to the first and second downward tube parts 31 and also to be locked by a third screw 32. A rectangle space 33 is formed on a center of the back frame 3. A plurality of forward hollow pipes 34 is formed on a surface rim of the back frame 3 near a periphery of the rectangle space 33. A plurality of nodes 41 corresponding to the plurality of forward hollow pipes 34 is formed on a rear part of the back pad 4, so that the plurality of nodes 41 are coupled to the plurality of forward hollow pipes 34 and locked by the third screw 32. A cover element 35 is smoothly covered on two sides of a lower part of the back frame 3.

Figure 3:
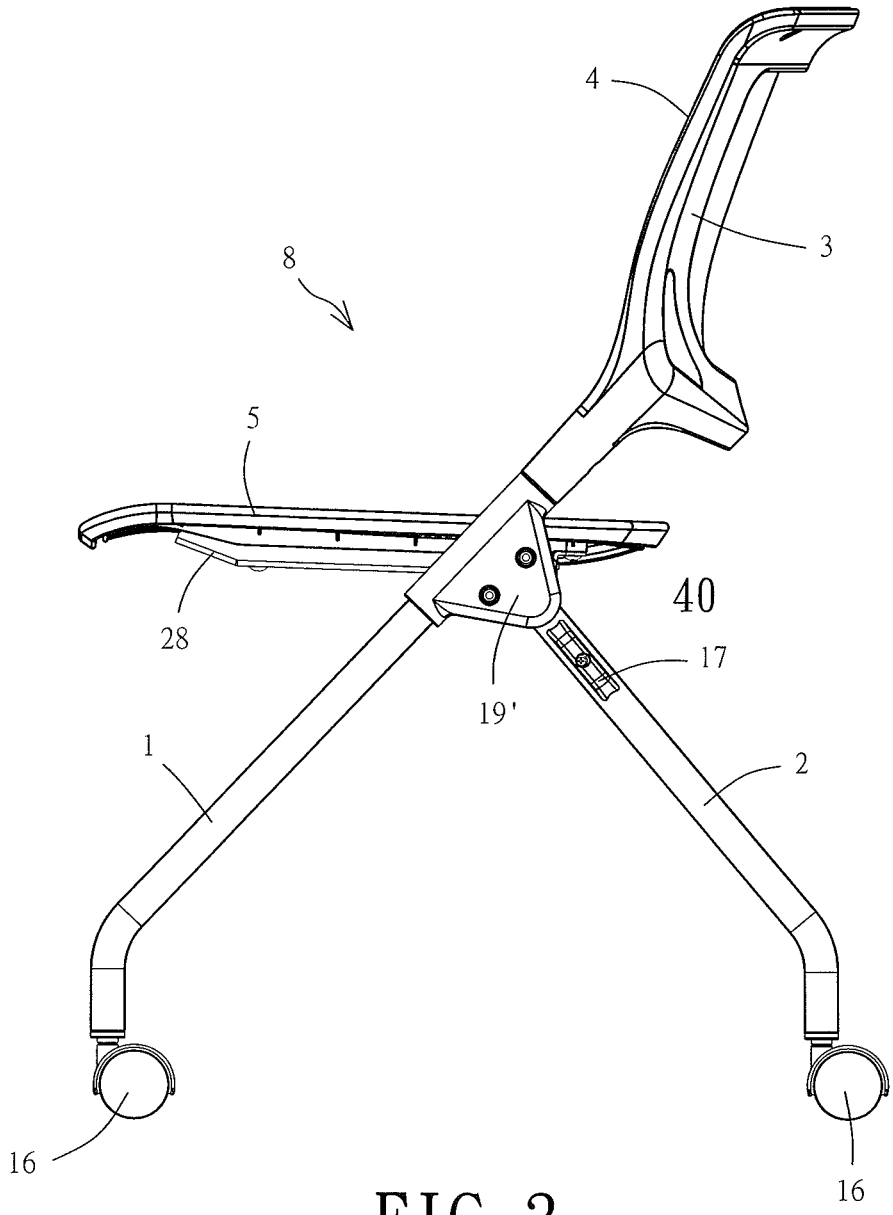
FIG. 3 shows a preferred embodiment of a schematic side view of a foldable seat structure of the present invention.

With reference to FIG. 1, FIG. 2 and FIG. 3, a flexible pad 17 is placed on an inner side surface of the front foot part 1 and an external side surface of the rear foot part of a specific height. When the foldable seat structure body 8 of the present invention is in use or folded, the flexible pad 17 can protect the front foot part 1 and the rear foot part 2 to keep a specific space, so that the pole parts of the front foot part 1 and the rear foot part 2 are not damaged due to friction.

With reference to FIG. 2 and FIG. 3, when the foldable seat structure body 8 including the front foot part 1, the rear foot part 2, the back frame 3, the back pad 4 and the chair cushion 5 is in use, the chair cushion 5 coupled to the rear foot part 2 can be horizontally moved forward, and the back pad 4 coupled to the front foot part 1 can be vertically moved backward to fit a person's comfortable sitting position.

Figure 5:
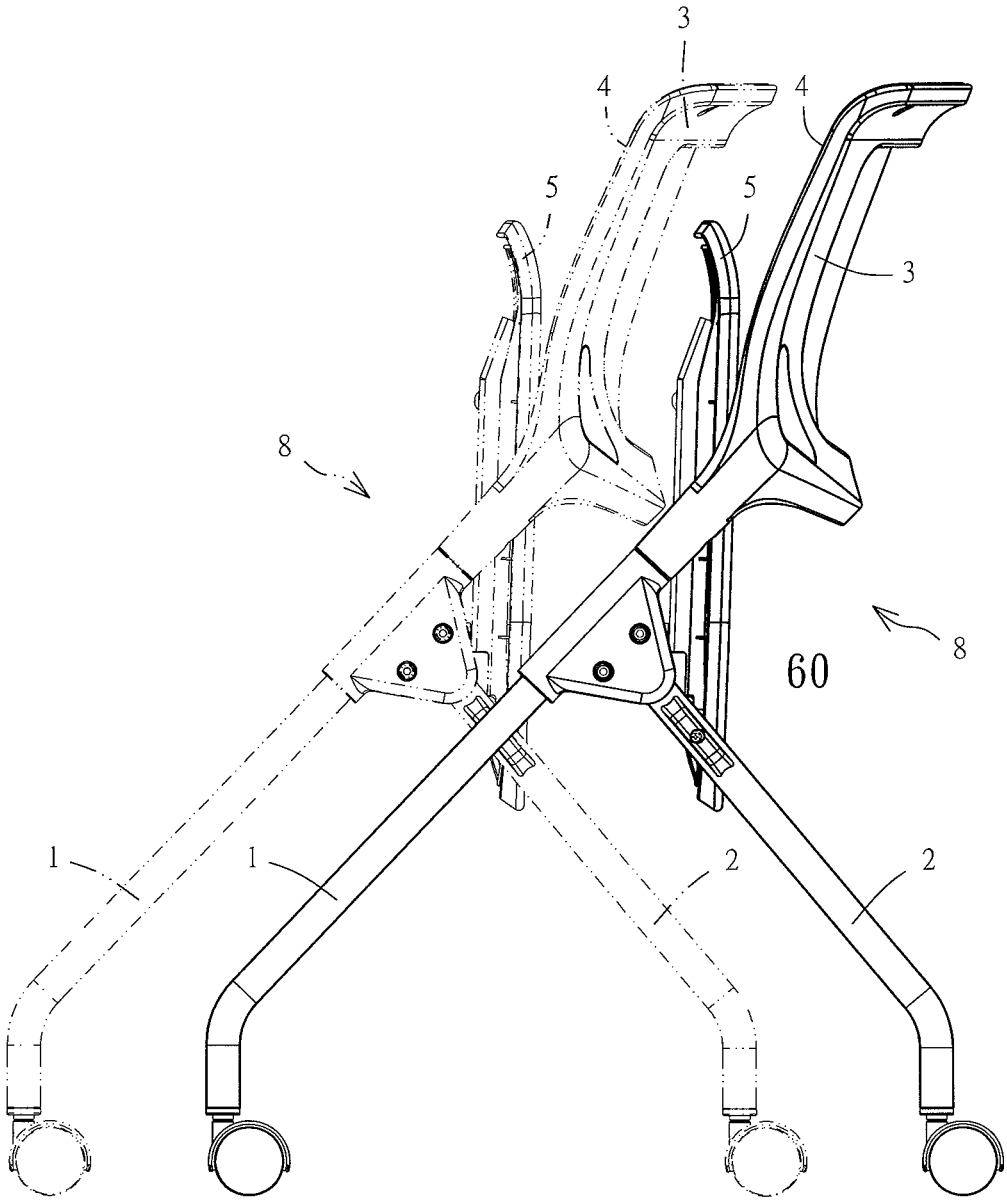
FIG. 5 shows a preferred embodiment of a schematic side view of a foldable seat structure of the present invention when a plurality of the foldable seat structures are cross-folding.
Figure 6:
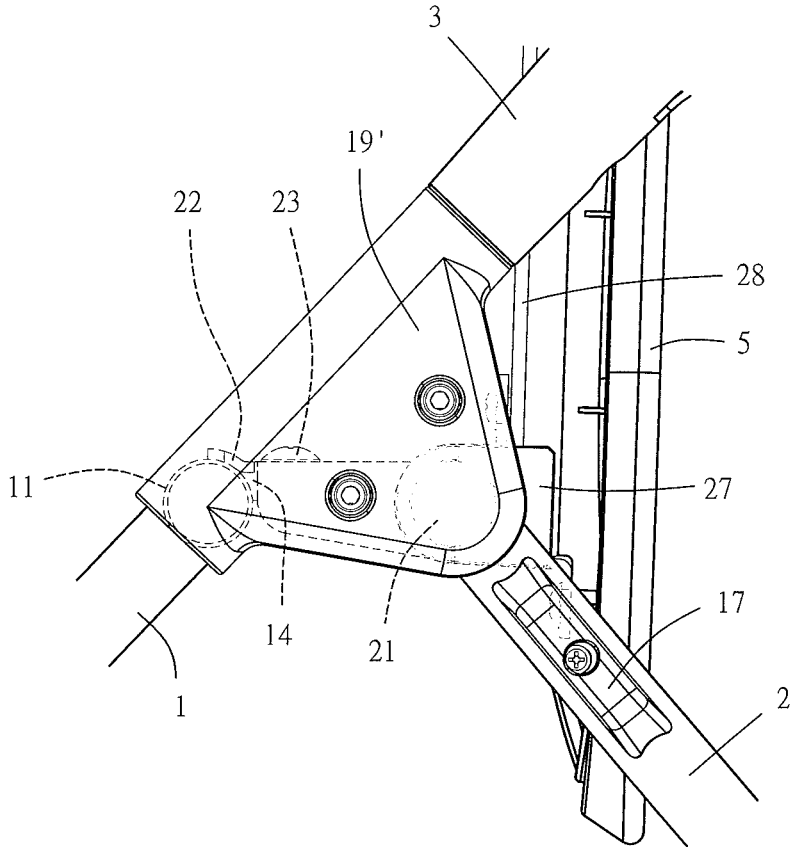
FIG. 6 shows a detail diagram of a part 60 of the aforesaid FIG. 5 of a foldable seat structure of the present invention.

With reference to FIG. 5 and FIG. 6, when the foldable seat structure body 8 is not in use to be folded, the chair cushion 5 coupled to the first and second connection units 27 of the rear foot part 2 is pulled upward. In this way, multiple foldable seat structure bodies 8 can be stacked to pile-up.

Figure 7:
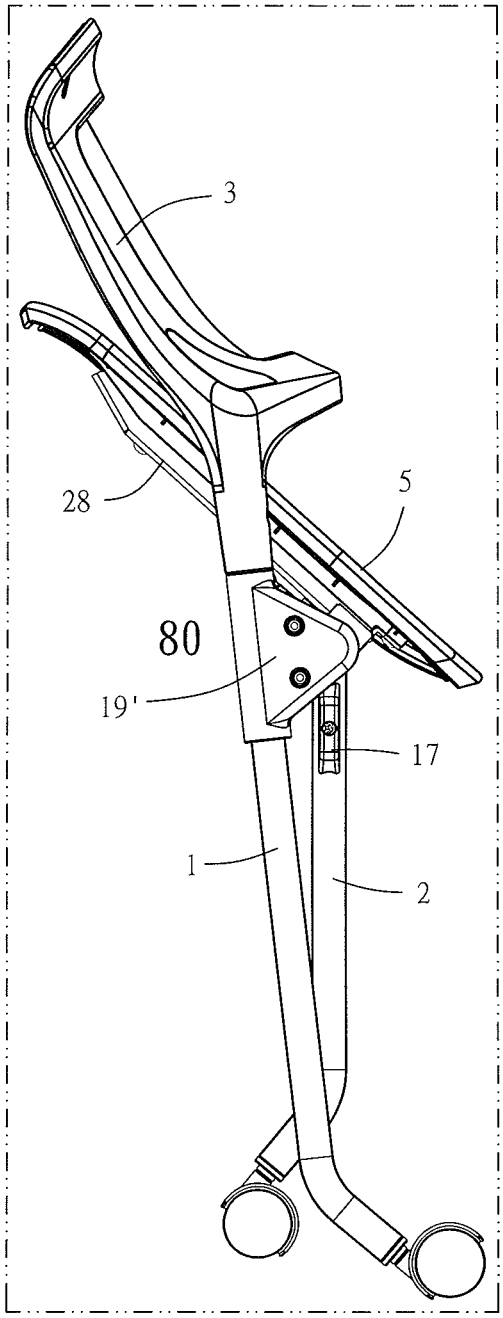
FIG. 7 shows a preferred embodiment of a schematic diagram of a foldable seat structure of the present invention when the foldable seat structures is folded to be transported.
Figure 8:
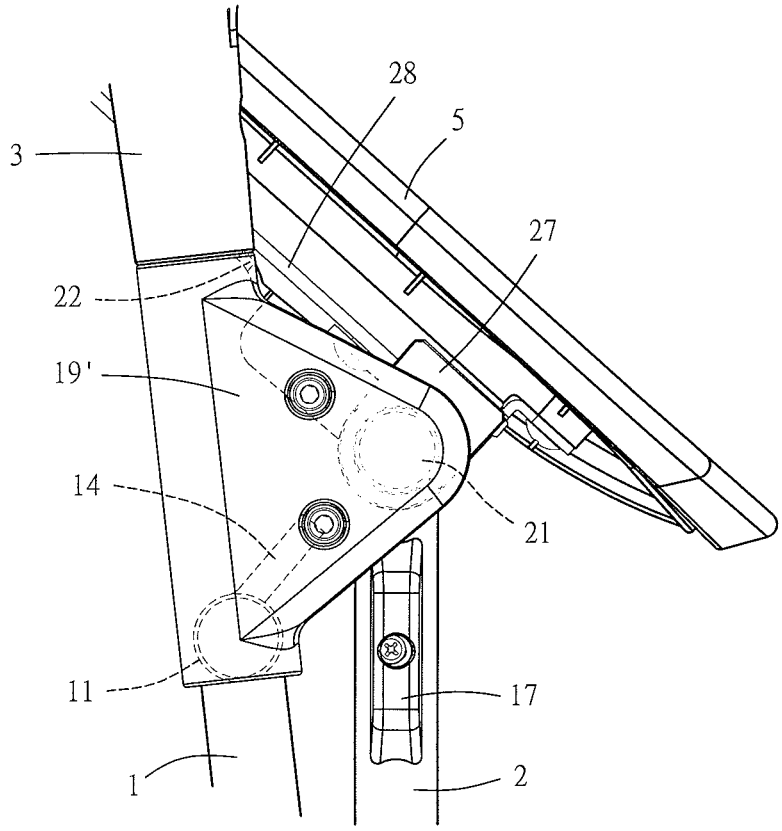
FIG. 8 shows a detail diagram of a part 80 of the FIG. 7 of a foldable seat structure of the present invention.

With reference to FIG. 7 and FIG. 8, when the foldable seat structure body 8 is packed to be sold, the first screw 23 of the first and second holding parts 14 of the front foot part 1 and the corresponding first and the second forward extending parts 22 of the rear foot part 2 is unlocked. The position of the first screw 23 is shown in FIG. 6. In this way, the rear foot part 2 coupled to the chair cushion 5 and the front foot part 1 coupled to the back pad 4 can perform an activity of cross-folding the front foot part 1 and the rear foot part 2, so that a folded size of the foldable seat structure body 8 is greatly reduced to facilitate pile-up for transportation.

Figure 9:
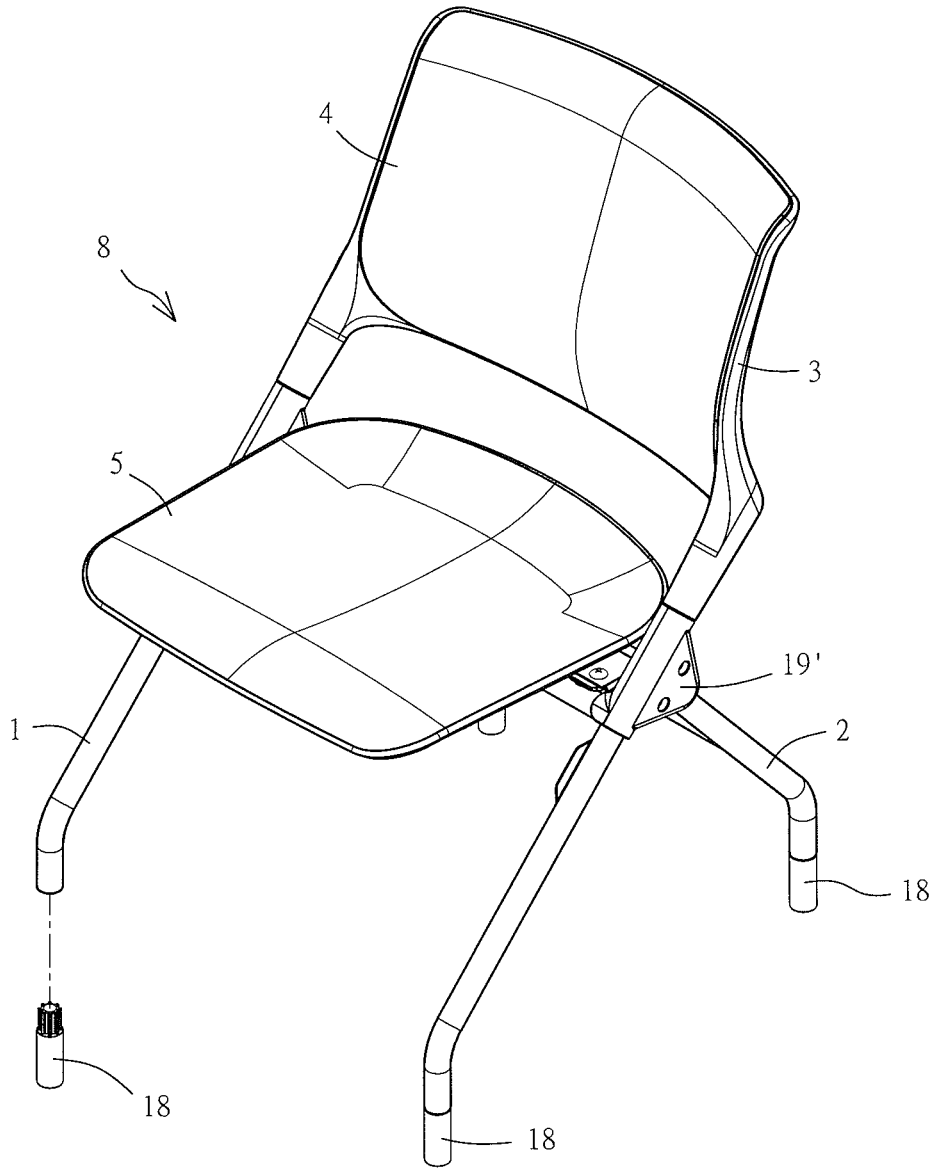
FIG. 9 shows a preferred embodiment of a schematic diagram of a flexible pillar coupled to a foot of a foldable seat structure body of the present invention.

With reference to FIG. 2 and FIG. 9, the wheel 16 pivoted at the bottom of the front foot part 1 and the rear foot part 2 of the foldable seat structure body 8 can be replaced by a flexible pillar 18 to make the foldable seat structure body 8 become a non-rolling form.

Figure 10:
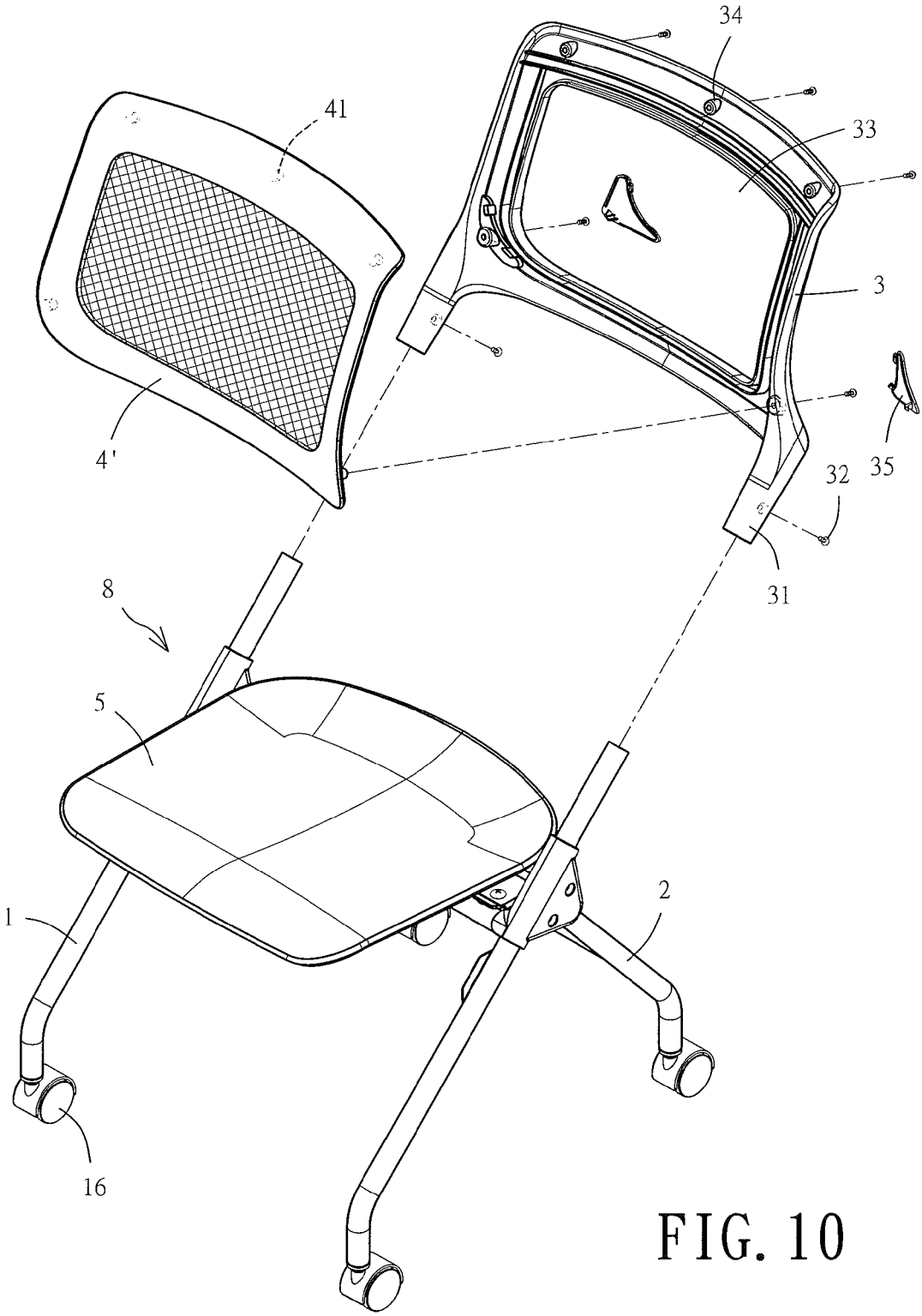
FIG. 10 shows a preferred embodiment of a schematic diagram of a mesh back pad coupled to a back frame of a foldable seat structure of the present invention.

In addition, with reference to FIG. 2 and FIG. 10, the back pad 4 of the back frame 3 coupled to the upper part of the front foot part 1 of the foldable seat structure body 8 can be replaced by a mesh back pad 4' to be cool and comfortable for a user.

Figure 11:
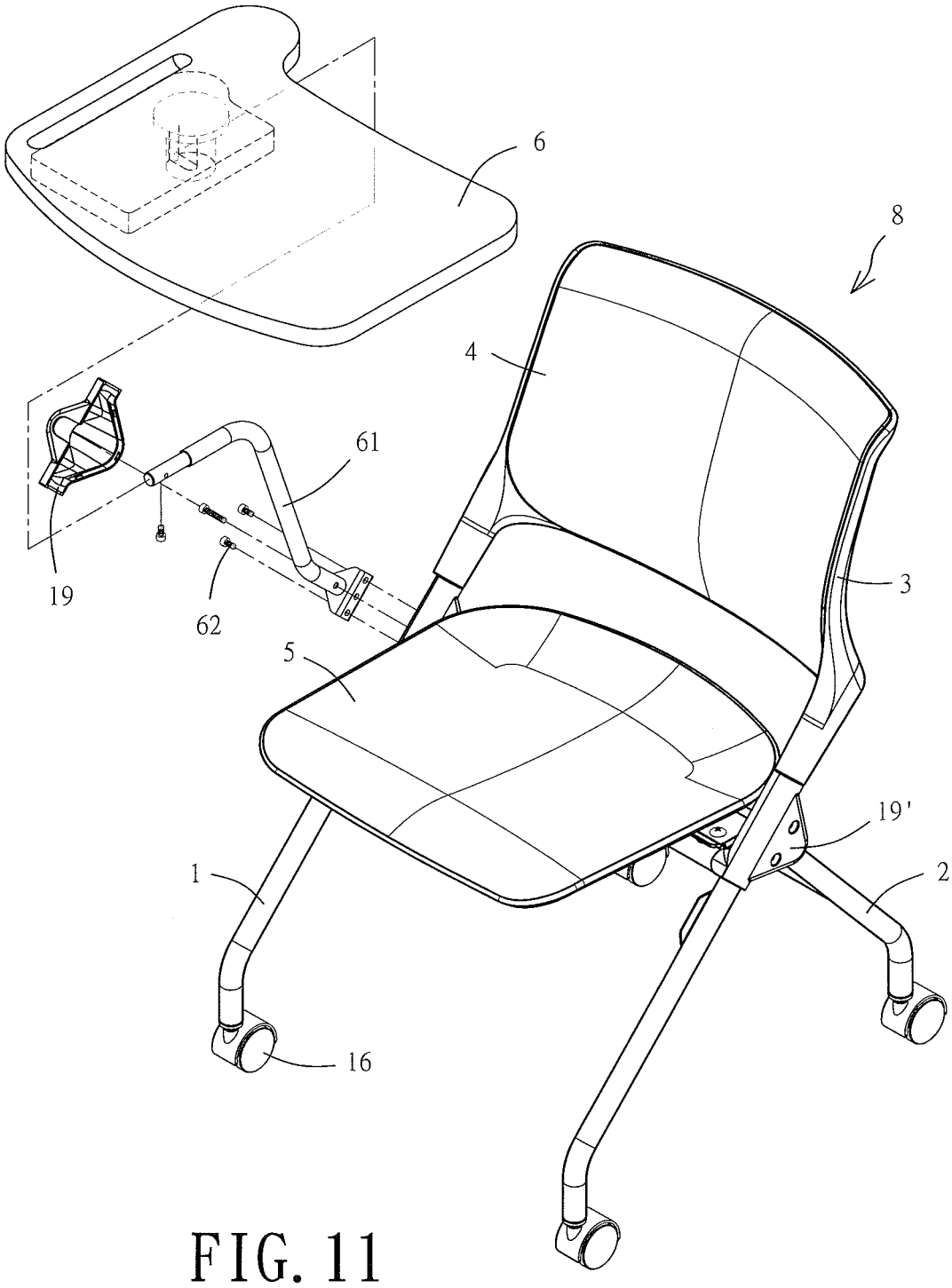
FIG. 11 shows a preferred embodiment of a schematic diagram of a single-sided tabletop coupled to a foldable seat structure body of the present invention.
Figure 12:
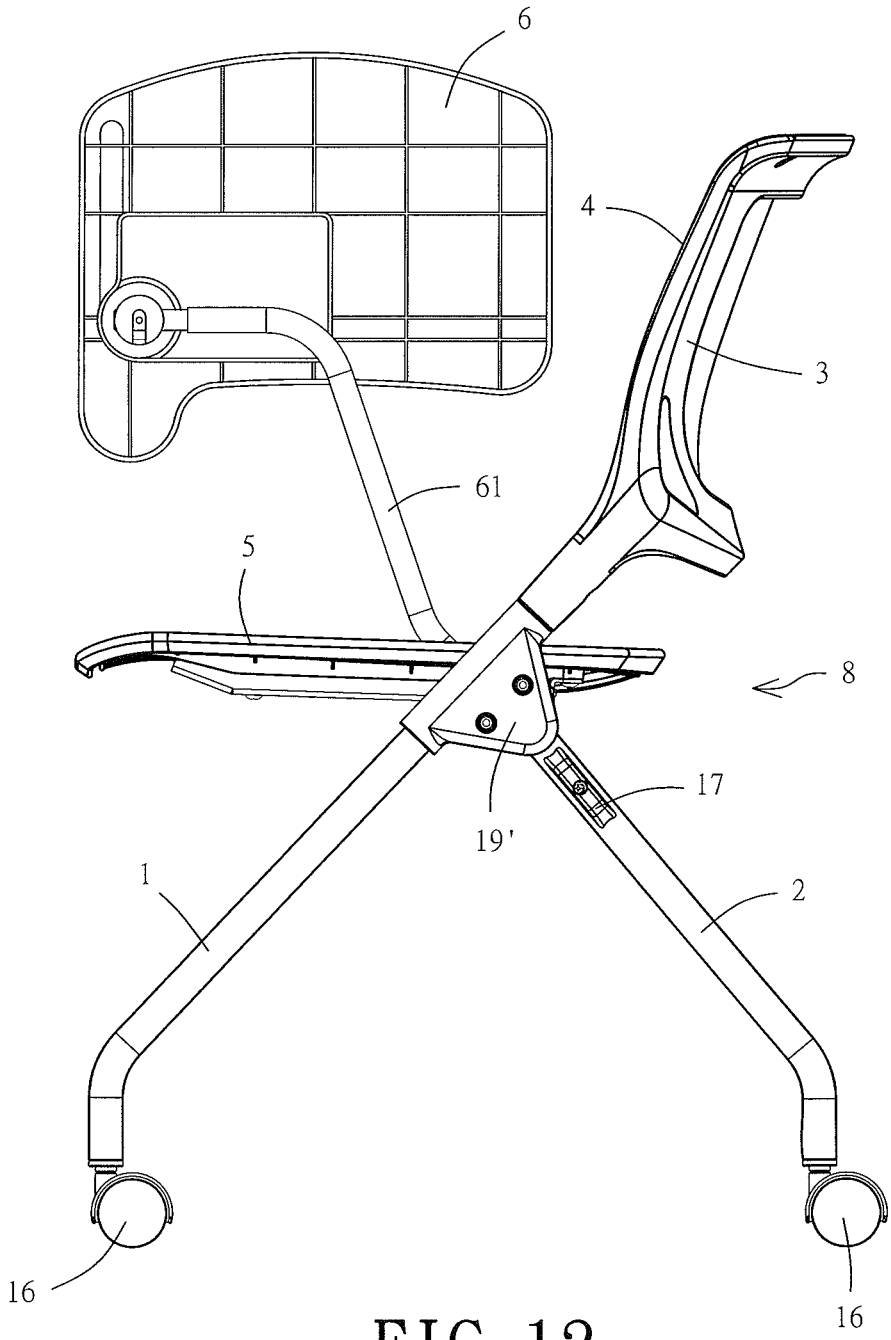
FIG. 12 shows a preferred embodiment of a schematic diagram of a foldable seat structure body of the present invention when a tabletop coupled to a single-sided handrail is pulled upward.

With reference to FIG. 11, a first handrail rod 61 can be configured to at least one of the first and second protruding shafts 13 of the front foot part 1 that are pivoted to the rear foot part 2 of the foldable seat structure body 8 of the present invention. A plurality of fourth screws 62 is used to fix the first handrail rod 61, to be coupled to a tabletop 6. With reference to FIG. 12, the tabletop 6 is in a state of pulling upward. A convex cover 19 is formed at a peripheral of the one of the first and second protruding shafts 13 of the front foot part 1 that is configured to the first handrail rod 61. On the other hand, a flat cover 19' is formed at a peripheral of the other one of the first and second protruding shafts 13 of the front foot part 1 that is not configured to the first handrail rod 61.

Figure 13:
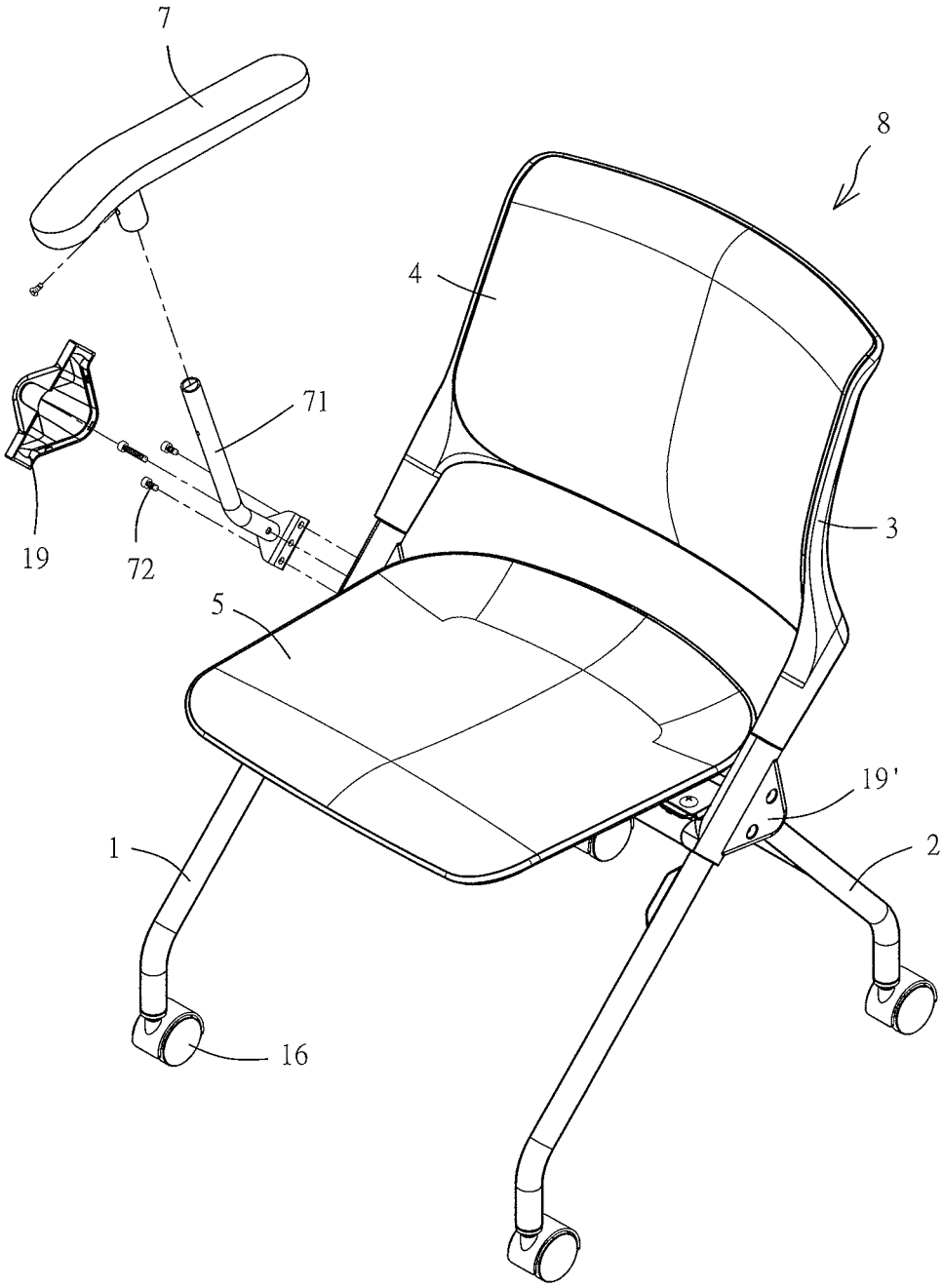
FIG. 13 shows a preferred embodiment of a schematic diagram of a single-sided handrail rod coupled to a foldable seat structure body of the present invention.
Figure 14:
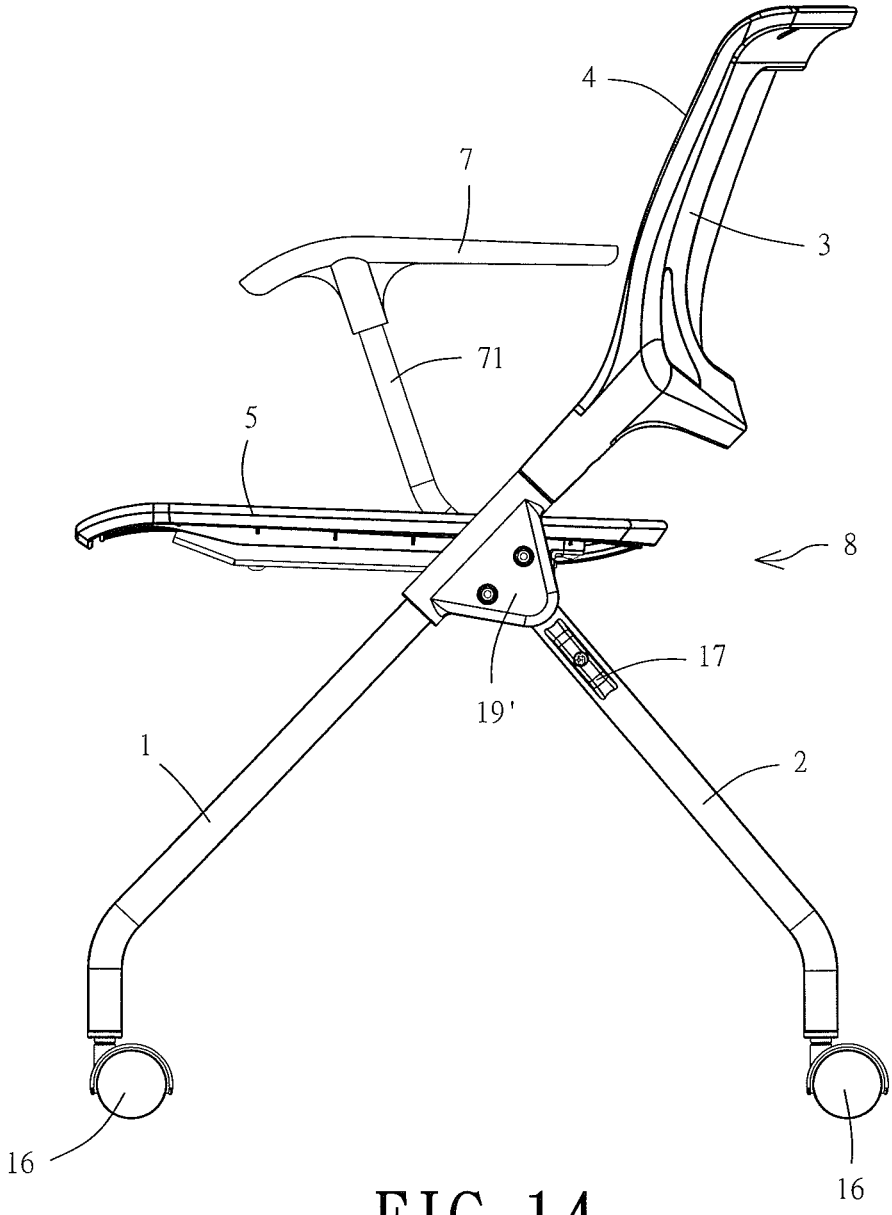
FIG. 14 shows a preferred embodiment of a schematic side view of a single-sided handrail rod coupled to a foldable seat structure body of the present invention.

With reference to FIG. 13, a second handrail rod 71 can be configured to at least one of the first and the second protruding shafts 13 of the front foot part 1 pivoted to the rear foot part 2 of the foldable seat structure body 8 of the present invention. A plurality of fifth screws 72 is used to fix the second handrail rod 71, to be coupled to a handrail board 7 as shown in FIG. 14. A convex cover 19 is formed at a peripheral of the one of the first and second protruding shafts 13 of the front foot part 1 that is configured to the second handrail rod 71. On the other hand, a flat cover 19' is formed at a peripheral of the other one of the first and second protruding shafts 13 of the front foot part 1 that is not configured to the second handrail rod 71.

Figure 15:
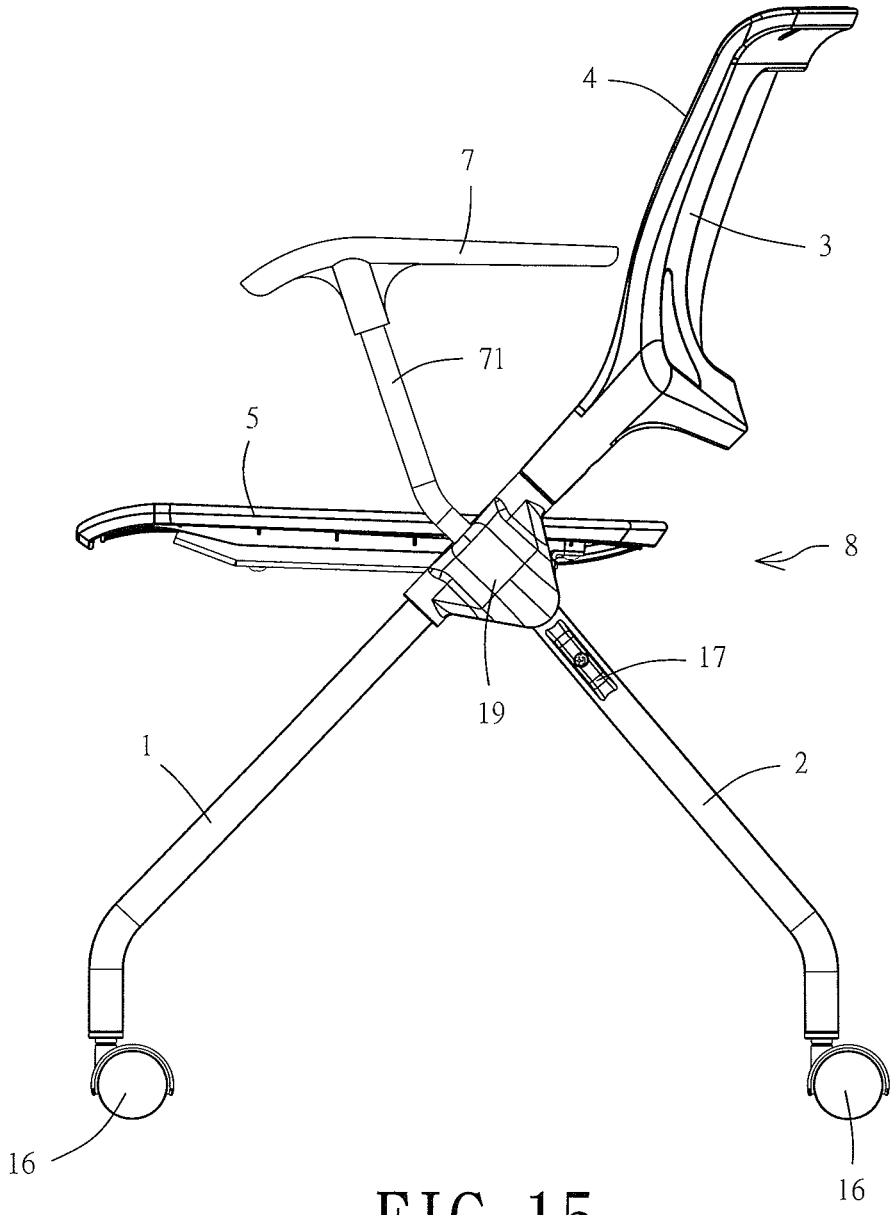
FIG. 15 shows a preferred embodiment of a schematic side view of the handrail rod respectively coupled to both sides of a foldable seat structure body of the present invention.

With reference to FIG. 15, the second handrail rod 71 is respectively configured at the side of the first and second protruding shafts 13 of the front foot part 1 pivoted to the rear foot 2 of the foldable seat structure body 8 of the present invention. The second handrail rod 71 is crewed to fix a position, to be coupled to the handrail board 7. The convex cover 19 is respectively used at the peripheral of the first and second protruding shafts 13 of the front foot part 1 that are configured to the second handrail rod 71.

Therefore, the present invention of the foldable seat structure greatly reduces a package size for transportation to be sold and also is very convenient to be assembled to the peripheral equipment by demand.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A foldable seat structure body comprising a front foot part, a rear foot part, a back frame, a back pad and a chair cushion; wherein the front foot part comprises a first upward extending part and a second upward extending part mounted on a first horizontal pole of a specific height across the front foot part separately with an optimal spacing; wherein each of the first and second upward extending parts comprises a downward opening; wherein a first protruding shaft and a second protruding shaft are formed on the front foot part at a same height near both ends of the first horizontal pole; wherein each of the first protruding shaft and the second protruding shaft comprises a through hole; wherein a first holding part and a second holding part having an opening are extended backward located between the first and second upward extending parts and the neighboring protruding shafts;

the rear foot part comprises a first forward extending part and a second forward extending part mounted on two ends of a second horizontal pole of the rear foot part, to go through the downward opening of the first and second extending parts of the front foot part; wherein the first and second forward extending parts are coupled to the corresponding first and second holding part; wherein a first screw is used to restrict a first joint position; wherein a flexible node is formed at two ends of the second horizontal pole on the rear foot part, to enable a support pole to go through the second horizontal pole of the rear foot part located between the first and second extending parts above the front foot part; wherein the support pole firmly goes through the first and second protruding shafts; wherein a latch is used to restrict a second joint position;

first and second upper pole parts of the front foot part are coupled to the back frame to be screwed; wherein the back pad is coupled to a front side of the back frame; wherein a first connection unit and a second connection unit are configured on two ends of the second horizontal pole on the rear foot part separately with an optimal space; wherein one end of the first and second connection units is coupled to a rear part of the chair cushion by screwing; wherein another end of the first and second connection units is mounted to a dragging part; wherein a front end of the dragging part is stably fixed to a front part of the chair cushion; and wherein when the foldable seat structure body is packed to be sold, the first screw of the first and second holding parts of the front foot part and the corresponding first and second forward extending parts of the rear foot part is unlocked; wherein the rear foot part coupled to the chair cushion and the front foot part coupled to the back pad allows cross-folding of the front foot part and the rear foot part, wherein a folded size of the foldable seat structure body is greatly reduced to facilitate pile-up for transportation.

2. The foldable seat structure body as claimed in claim 1, wherein a first handrail rod is configured to at least one of the first and second protruding shafts of the front foot part pivoted to the rear foot part; wherein the first handrail rod is coupled to a tabletop; and wherein a convex cover is formed at a peripheral of the one of the first and second protruding shafts of the front foot part that is configured to the first handrail rod.

3. The foldable seat structure body as claimed in claim 1, wherein a second handrail rod is configured to at least one of the first and second protruding shafts of the front foot part pivoted to the rear foot part; wherein the second handrail rod is coupled to a handrail board; and wherein a convex cover is formed at a peripheral of the one of the first and second protruding shafts of the front foot part that is configured to the second handrail rod.

4. The foldable seat structure body as claimed in claim 1, wherein a bottom of the front foot part and the rear foot part are further configured with a wheel by demand.

5. The foldable seat structure body as claimed in claim 1, wherein a bottom of the front foot part and the rear foot part are further configured with a pillar by demand.

6. The foldable seat structure body as claimed in claim 1, wherein the back pad of the back frame coupled to the upper part of the front foot part is a mesh back pad to be cool and comfortable for a user.

* * * * *